US009812268B2

(12) United States Patent
Cowans

(10) Patent No.: US 9,812,268 B2
(45) Date of Patent: Nov. 7, 2017

(54) SYSTEMS AND METHODS FOR LOCKING A CIRCUIT BREAKER

(71) Applicant: Siemens Aktiengesellschaft, München (DE)

(72) Inventor: John Quentin Cowans, Decatur, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/041,155

(22) Filed: Feb. 11, 2016

(65) Prior Publication Data

US 2017/0236660 A1 Aug. 17, 2017

(51) Int. Cl.
*H01H 9/28* (2006.01)
*E05B 65/00* (2006.01)
*E05B 55/00* (2006.01)

(52) U.S. Cl.
CPC ..... *H01H 9/285* (2013.01); *E05B 55/005* (2013.01); *E05B 65/006* (2013.01)

(58) Field of Classification Search
CPC ..... H01H 9/20; H01H 9/282; H01H 9/283; H01H 9/285
USPC ..... 200/43.11, 43.01; 335/168
See application file for complete search history.

(56) References Cited

U.S. PATENT DOCUMENTS 4,000,382 A * 12/1976 Kolb ..... H01H 13/72 200/336
6,192,718 B1 * 2/2001 Bollinger, Jr. ..... H01H 9/285 70/2
6,989,499 B2 * 1/2006 Bortolloni ..... H01H 9/28 200/329
8,084,895 B2 * 12/2011 Allen ..... H01H 9/283 307/326
8,389,880 B2 * 3/2013 Lee ..... H01H 9/285 200/4

* cited by examiner

*Primary Examiner* — Vanessa Girardi

(57) ABSTRACT

A circuit breaker includes an accessory pocket, an accessory cover and a locking device to lock the circuit breaker such that an unauthorized switching of the circuit breaker from OFF to ON or from ON to OFF states is prevented. The locking device includes a first subassembly including a pocket housing. The first subassembly is configured to be installed in the accessory pocket. The locking device further includes a second subassembly including a cylinder lock. The second subassembly is configured to be mounted to the accessory cover. The first subassembly and the second subassembly are configured to self align upon final assembly of the circuit breaker to perform a locking function of the circuit breaker. In this way, the locking device prevents circumvention of a locking feature and selectively provides an ability to lock in an ON state of the circuit breaker.

17 Claims, 16 Drawing Sheets

FIG. 24
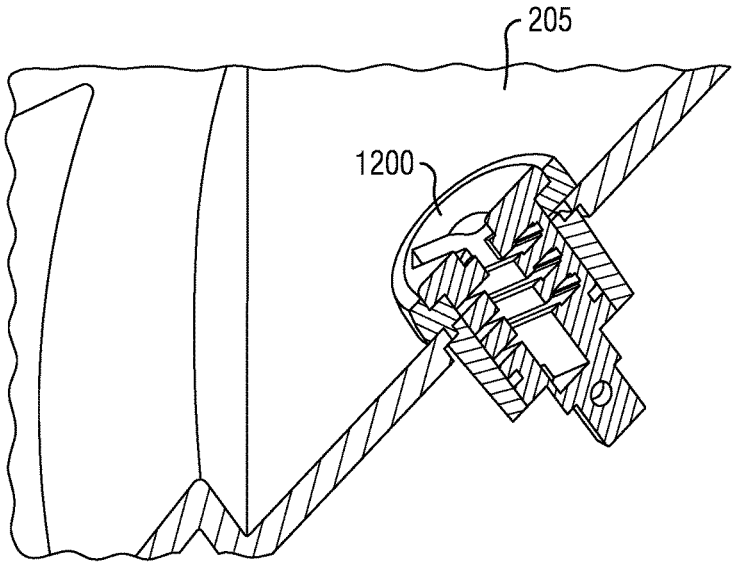
FIG. 25
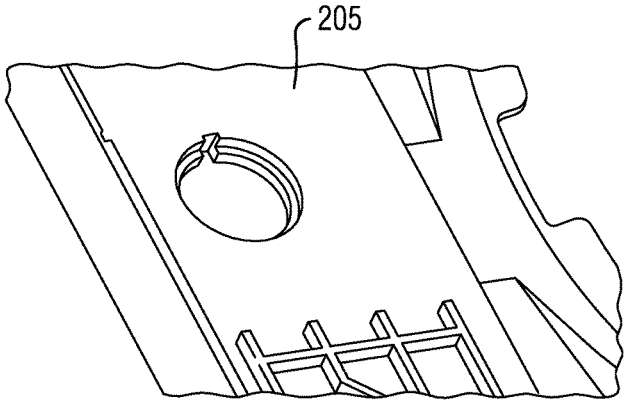
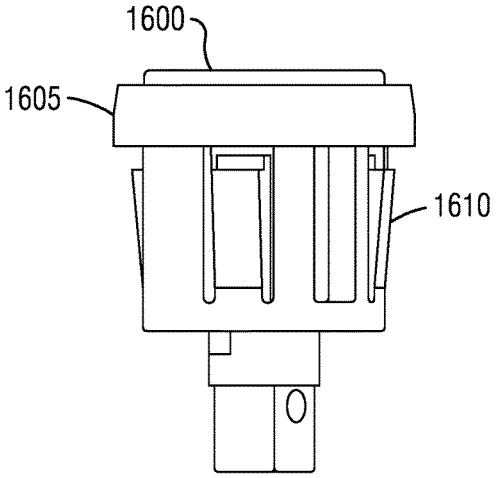
FIG. 26

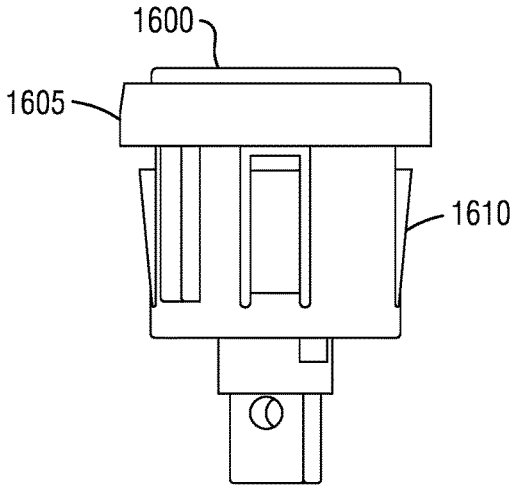
FIG. 27
FIG. 28
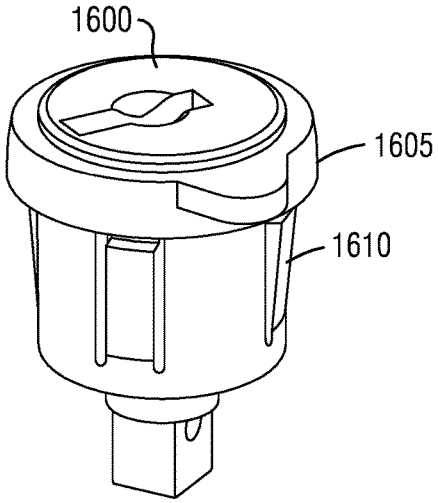
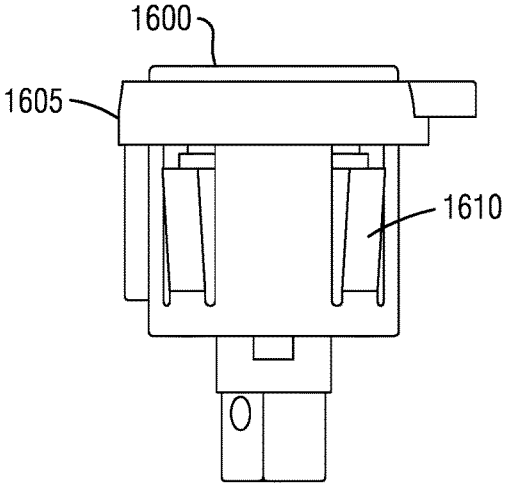
FIG. 29

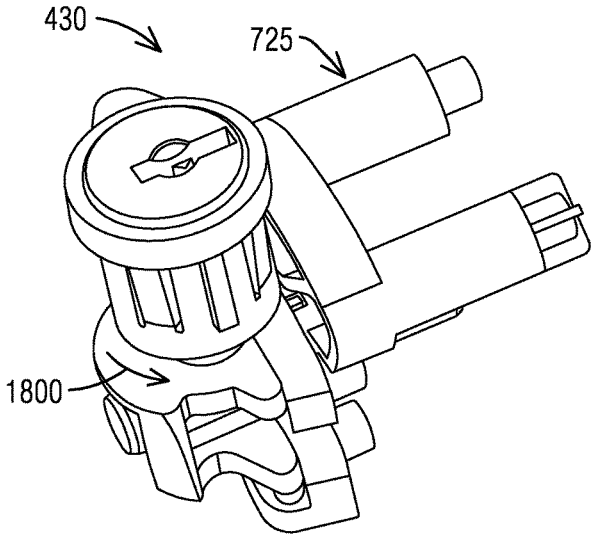
FIG. 32
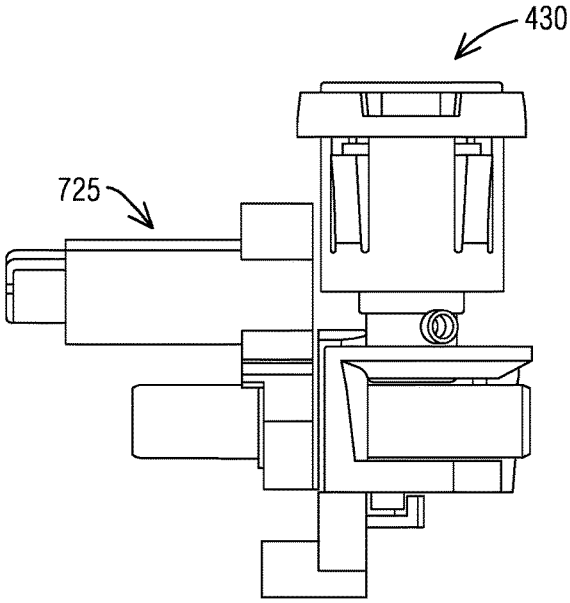
FIG. 33
FIG. 34
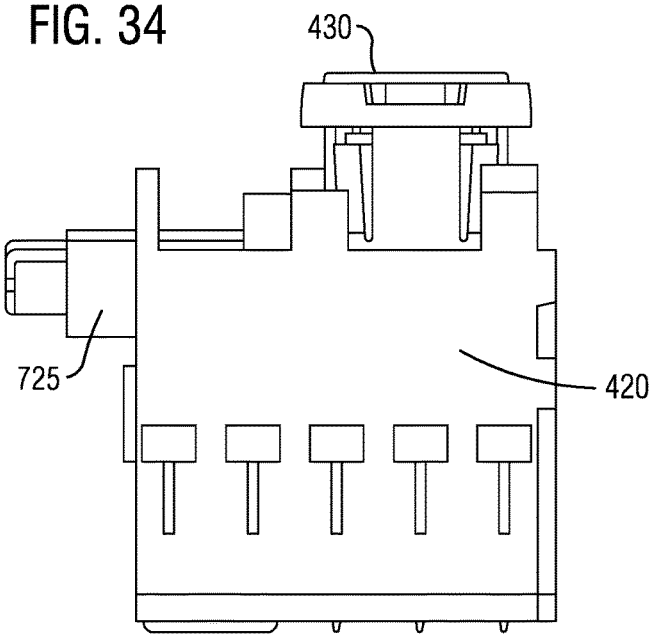

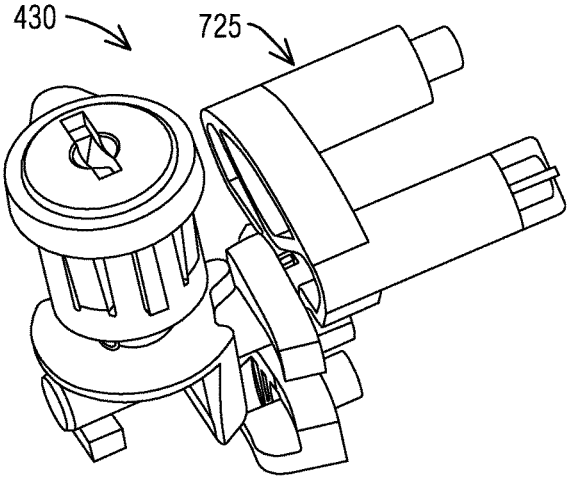
FIG. 35
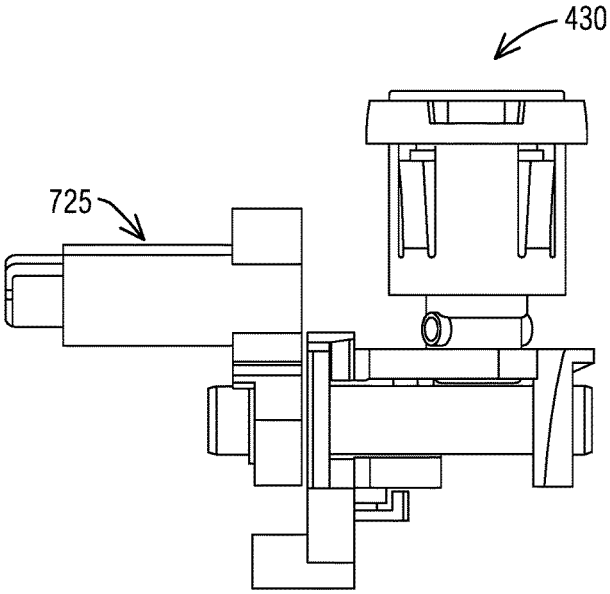
FIG. 36
FIG. 37
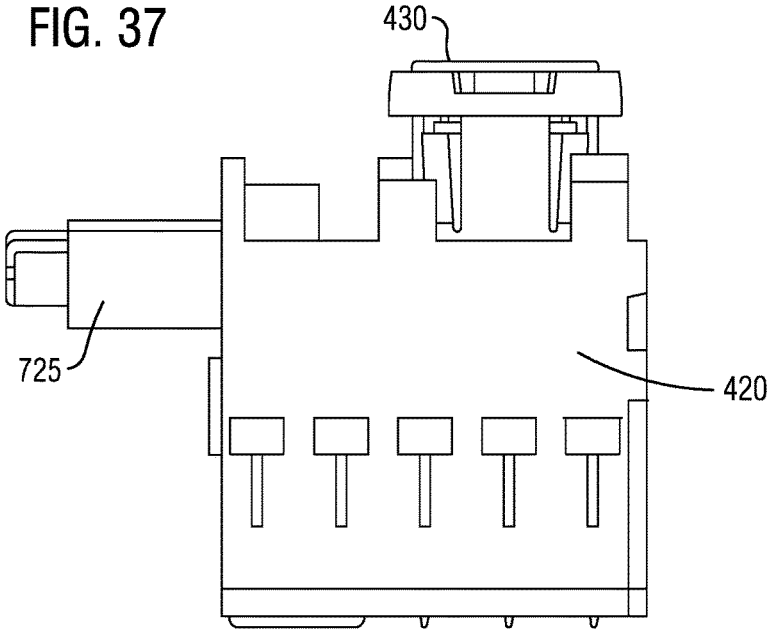

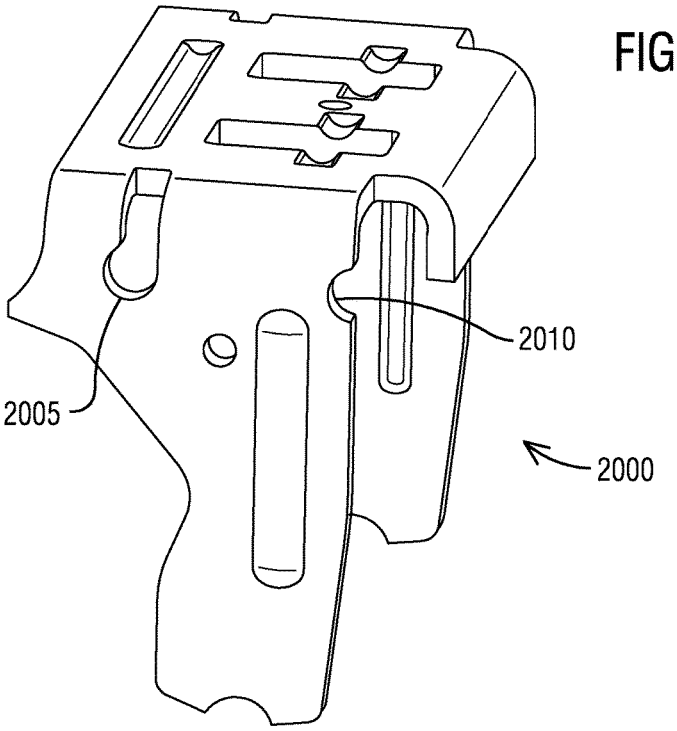
FIG. 38
FIG. 39
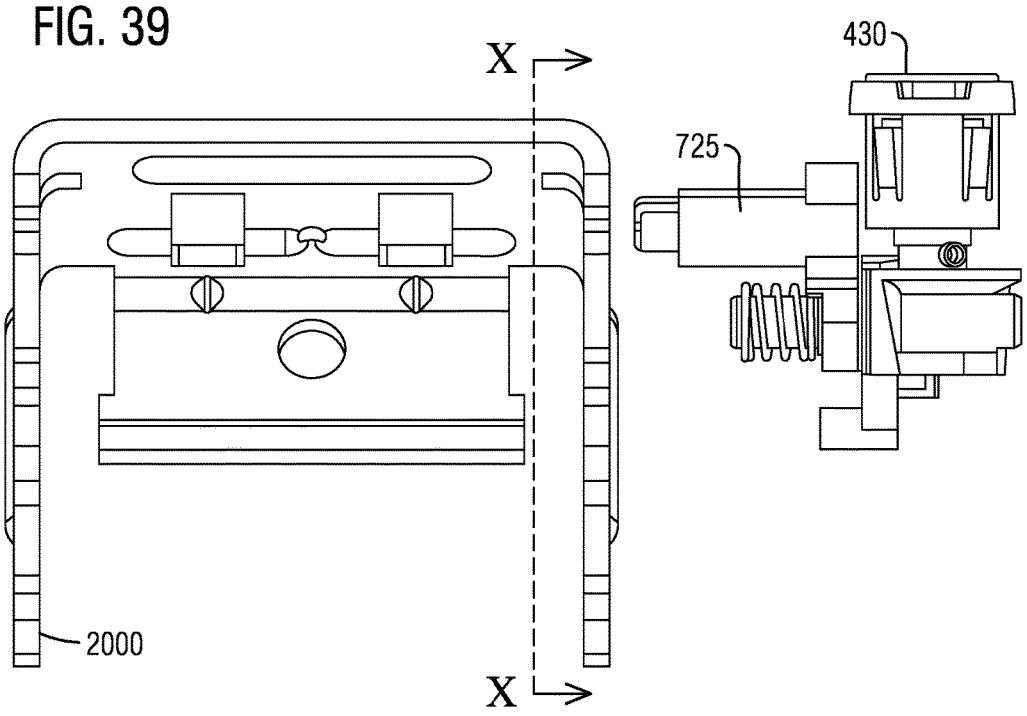

SYSTEMS AND METHODS FOR LOCKING A CIRCUIT BREAKER

BACKGROUND

1. Field

Aspects of the present invention generally relate to a mechanism for locking a circuit breaker and more specifically relates to a key locking device or an accessory that prevents circumvention of a locking feature and selectively provides an ability to lock in an ON state of the circuit breaker.

2. Description of the Related Art

Locking of circuit breakers is essential to protect property and life from electrical hazards. Locking of a circuit breaker allows a user to prevent the circuit breaker from being switched from OFF to ON or vice-versa by some other unauthorized person. Locking the circuit breaker is typically done by blocking the movement of a handle on the exterior of the circuit breaker housing, usually with some type of assembly that employs a pad lock.

Among other things, a circuit breaker may include a circuit breaker accessory pocket, a tripping mechanism and contacts. A cylinder lock mechanism that resides in a circuit breaker accessory pocket is also used to actuate a tripping mechanism of a circuit breaker. "Locking" the circuit breaker forces the circuit breaker into the "tripped" state causing the contacts to open if they are closed at the time of "locking" and preventing the operating mechanism from acting on the contacts to close them.

However, circumvention of a locking feature via disassembly can allow an unauthorized person to gain access to the switching functionality of a locked circuit breaker. Circuit breaker locking is generally intended to provide the ability to lock the breaker only in the OFF state. Because of the safety implications of locking a circuit breaker in the ON state, an ability to lock the circuit breaker in the ON state is generally not provided. Although under some circumstances an ability to safely lock the circuit breaker in the ON state may be needed.

Therefore, there is a need for improvements in locking mechanisms for locking a circuit breaker.

SUMMARY

Briefly described, aspects of the present invention relate to a mechanism for locking a circuit breaker. In particular, it relates to a key locking device or an accessory that prevents circumvention of a locking feature and selectively provides an ability to lock in an ON state of the circuit breaker. One of ordinary skill in the art appreciates that such a locking system can be configured to be installed in different environments where locking control is needed, for example, in a circuit breaker.

In accordance with one illustrative embodiment of the present invention, a circuit breaker is provided. The circuit breaker comprises an accessory pocket, an accessory cover and a locking device to lock the circuit breaker such that an unauthorized person is prevented from switching the circuit breaker from OFF to ON or from ON to OFF. The locking device includes a first subassembly including a pocket housing and a second subassembly including a cylinder lock. While the first subassembly is configured to be installed in the accessory pocket, the second subassembly is configured to be mounted to the accessory cover. The first subassembly and the second subassembly are configured to self align upon final assembly of the circuit breaker to perform a locking function of the circuit breaker.

In accordance with another illustrative embodiment of the present invention, a key locking device accessory for use with a circuit breaker is provided. The key locking device accessory comprises a locking device to lock the circuit breaker such that an unauthorized person is prevented from switching the circuit breaker from OFF to ON or from ON to OFF. The locking device includes a first subassembly including a pocket housing and a second subassembly including a cylinder lock. While the first subassembly is configured to be installed in an accessory pocket, the second subassembly is configured to be mounted to an accessory cover. The first subassembly and the second subassembly are configured to self align upon final assembly of the circuit breaker to perform a locking function of the circuit breaker.

In accordance with yet another illustrative embodiment of the present invention, a method of locking a circuit breaker is provided. The method comprises providing a first locking device subassembly including a pocket housing and providing a second locking device subassembly including a cylinder lock. While the first locking device subassembly is configured to be installed in an accessory pocket, the second locking device subassembly is configured to be mounted to an accessory cover. The first locking device subassembly and the second locking device subassembly are configured to self align upon final assembly of the circuit breaker to perform a locking function of the circuit breaker such that an unauthorized person is prevented from switching the circuit breaker from OFF to ON or from ON to OFF.

BRIEF DESCRIPTION OF THE DRAWINGS

FIGS. 22-24 illustrate isometric views of an accessory cover and a lock in accordance with an exemplary embodiment of the present invention.

FIG. 25 illustrates an isometric view of an accessory cover without a ring in accordance with an exemplary embodiment of the present invention.

FIGS. 26-27 illustrate isometric views of a lock and a lock housing in accordance with an exemplary embodiment of the present invention.

FIGS. 28-29 illustrate side views of a lock and a lock housing in accordance with an exemplary embodiment of the present invention.

FIG. 32 illustrates an isometric view of a cylinder lock assembly with a locking pin subassembly in an unlocked state in accordance with an exemplary embodiment of the present invention.

FIGS. 33-34 illustrate side views of a cylinder lock assembly with a locking pin subassembly in an unlocked state in accordance with an exemplary embodiment of the present invention.

FIGS. 35-37 illustrate an isometric view of a cylinder lock assembly with a locking pin subassembly in a locked state in accordance with an exemplary embodiment of the present invention.

FIG. 38 illustrates an isometric view of a handle of a circuit breaker in accordance with an exemplary embodiment of the present invention.

FIG. 39 illustrates a side view of a handle of a circuit breaker and a cylinder lock assembly with a locking pin subassembly in accordance with an exemplary embodiment of the present invention.

DETAILED DESCRIPTION

To facilitate an understanding of embodiments, principles, and features of the present invention, they are explained hereinafter with reference to implementation in illustrative embodiments. In particular, they are described in the context of being a locking device configured to lock a circuit breaker such that circumvention of a locking feature via disassembly is denied to an unauthorized person to gain access to the switching functionality of a locked circuit breaker. An ability to lock the circuit breaker in the ON state is also provided. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
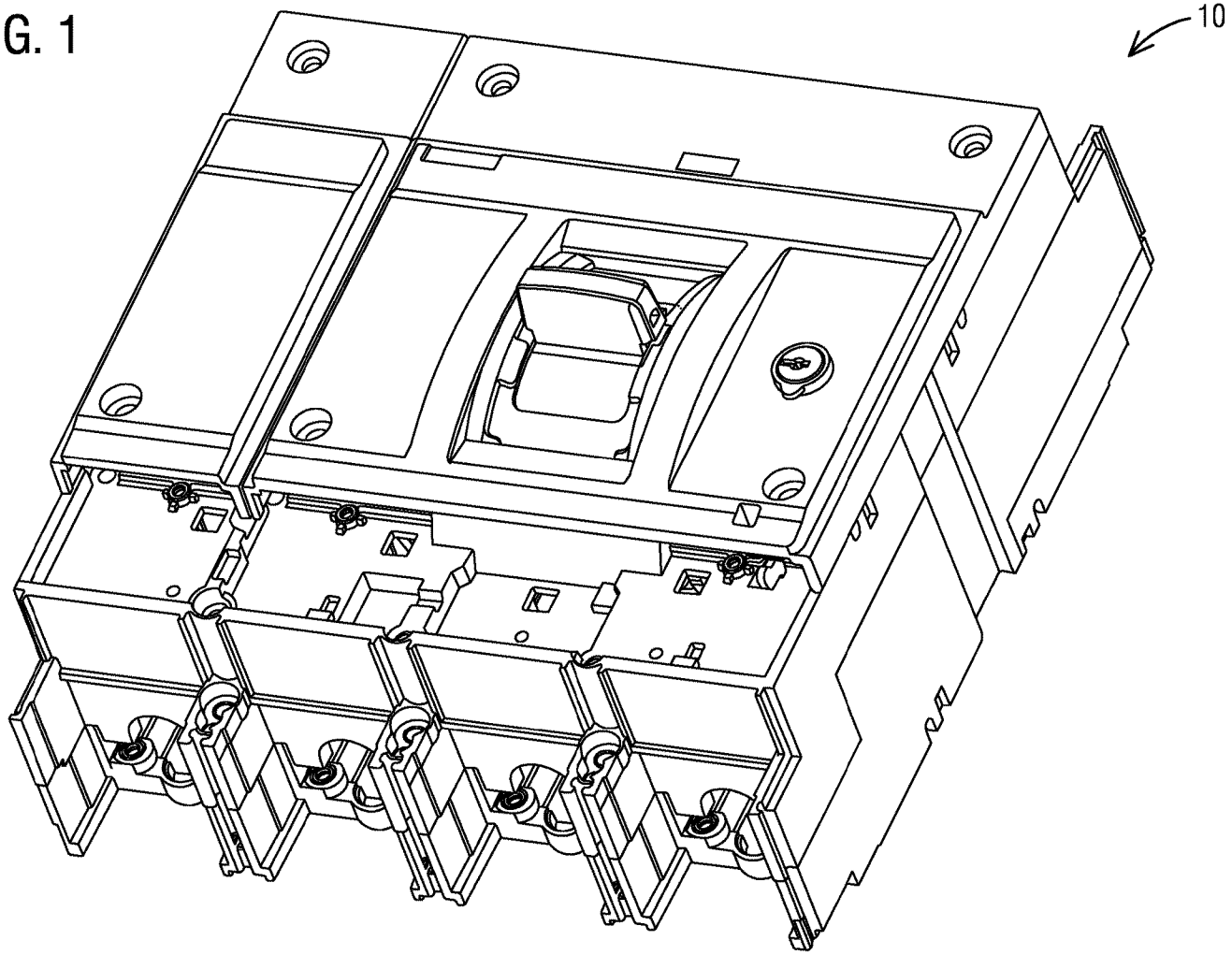
FIG. 1 illustrates an isometric view of a circuit breaker in accordance with an exemplary embodiment of the present invention.

Consistent with one embodiment of the present invention, FIG. 1 represents an isometric view of a circuit breaker 10. The circuit breaker 10 protects electrical apparatus. For example, molded case circuit breaker offers solutions for power distribution applications. The circuit breaker 10 may have rated current from 16 A to 1600 A. It may be a multi-pole circuit breaker such as a 3 Pole or a 4 Pole. The circuit breaker 10 may include a Thermal Magnetic and Microprocessor based electronic trip units (ETUs) and it may have communication capable ETUs. Typical applications include incoming and outgoing circuit breakers in power distribution applications or switching and protection devices for motors, transformers, generators, capacitors, busbars and cables. The circuit breaker 10 may include Molded Case Switches or Motor Circuit Protectors. The circuit breaker 10 may alternatively have a power range from 630 A to 6300 A. The type of circuit breakers is suitable for applications up to 1150 VAC and as non-automatic switches up to 1000 VDC. The circuit breaker 10 may alternatively have size up to 5000 A with a switching capacity 65 kA/100 kA at up to 480 VAC. Available constructions to choose from may be 1 Pole 120V, 2 Pole 120/240V, 2 Pole 240V, 3 Pole 240V. The circuit breaker 10 may have an ability to supply up to 250 A at 240 VAC up to 100 KAIC.

For example, the circuit breaker 10 is for use in individual enclosures, switchboards, panelboards, and load centers. The circuit breaker 10 may include a Thermal Magnetic Trip Unit (TMTU). The Thermal Magnetic Trip Unit (TMTU) may provide complete overload and short circuit protection by use of a time delay thermal trip element and an instantaneous magnetic trip element. The circuit breaker 10 may include a molded case switch having a factory-installed preset instantaneous function to allow the switch to trip at a value over 1000 A and protect itself against high fault conditions. Overload and fault current protection may be provided by separate over-current devices.

In the circuit breaker 10 being a 4-pole circuit breaker, with the mechanism latched and the contacts open, an operating handle will be in the OFF position. Moving the operating handle to the ON position closes the contacts and establishes a circuit through the circuit breaker 10. Under overload or short circuit conditions sufficient to automatically trip or open the circuit breaker 10, the operating handle moves to a position between ON and OFF. To relatch the circuit breaker 10 after automatic operation, the operating handle can be moved to the extreme OFF position. The circuit breaker 10 becomes ready for reclosing. An overcenter toggle mechanism may be trip free of the operating handle. The circuit breaker 10, therefore, cannot be held closed by means of the operating handle should a tripping condition exist. After automatic operation, the operating handle assumes an intermediate position between ON and OFF, thus displaying a clear indication of tripping.

As used herein, the "circuit breaker" refers to a single or multi-pole circuit breaker, as described herein, which corresponds to an automatically operated electrical switch designed to protect an electrical circuit from damage caused by overload or short circuit. Its basic function is to detect a fault condition and interrupt current flow. The "multi-pole circuit breaker," in addition to the exemplary hardware description above, refers to a device that is configured to reset (either manually or automatically) to resume normal operation. The "multi-pole circuit breaker," may be used to protect an individual household appliance up to a large switchgear designed to protect high voltage circuits feeding an entire city, and operated by a controller. It should be appreciated that several other components may be included in the "multi-pole circuit breaker." The "multi-pole circuit breaker," may be capable of operating based on its features such as voltage class, construction type, interrupting type, and structural features.

A circuit breaker cylinder locking accessory described here includes at least two subassemblies. A first subassembly being a pocket assembly includes an enclosure and a cover which houses a mechanism that interfaces with the circuit breaker's operating mechanism. The pocket assembly is installed into an accessory pocket of the circuit breaker 10. A second subassembly being a cylinder lock assembly includes a standard cylinder lock, a lock housing and a flipper component. The cylinder lock assembly is installed into a hole in an accessory cover of the circuit breaker 10.

Figure 2:
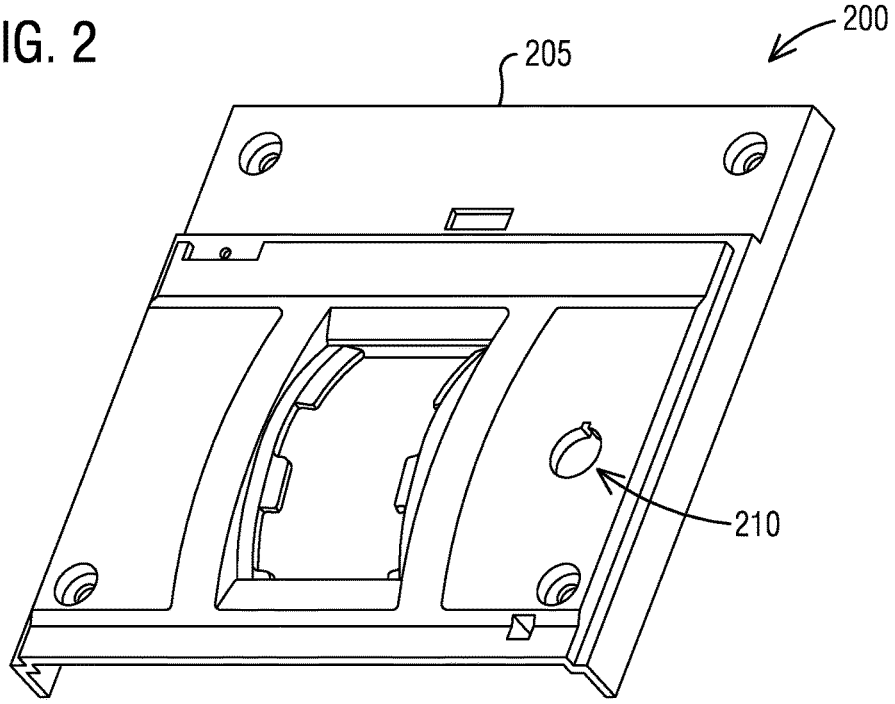
FIG. 2 illustrates an isometric view of a front side of an accessory cover of the circuit breaker in accordance with an exemplary embodiment of the present invention.

Referring to FIG. 2, it illustrates an isometric view of a front side 200 of an accessory cover 205 of the circuit breaker 10 in accordance with an exemplary embodiment of the present invention. The accessory cover 205 includes a cylinder lock mounting opening 210 to receive a cylinder lock (not shown).

Figure 3:
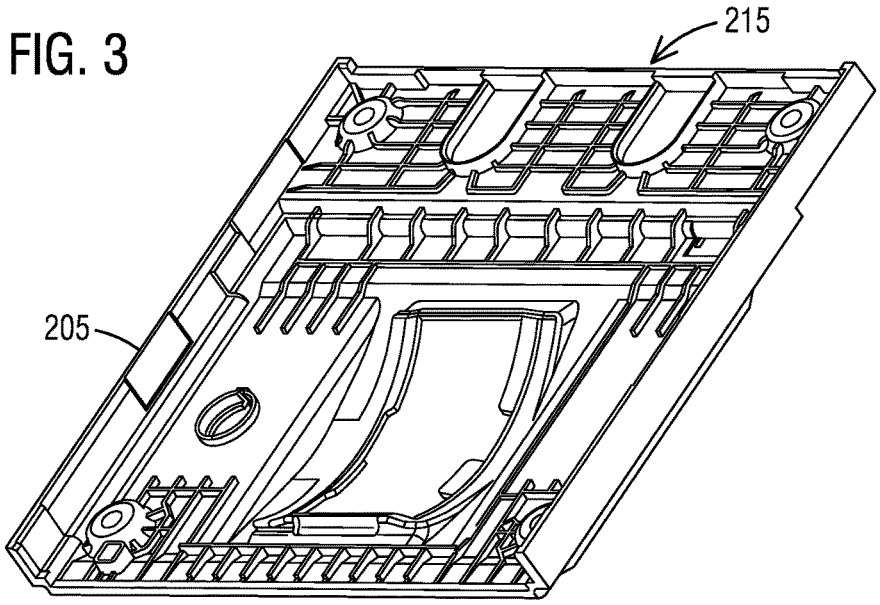
FIG. 3 illustrates an isometric view of a back side of the accessory cover of the circuit breaker in accordance with an exemplary embodiment of the present invention.

Referring to FIG. 3, it illustrates an isometric view of a back side 215 of the accessory cover 205 of the circuit breaker 10 in accordance with an exemplary embodiment of the present invention. Consistent with one embodiment, the accessory cover 205 may be made of hard plastic via an injection molding process or made of a metal such as stainless steel. However, the function and use of such equipment for injection molding circuit breaker parts are well known in the art and are not discussed further.

Figure 4:
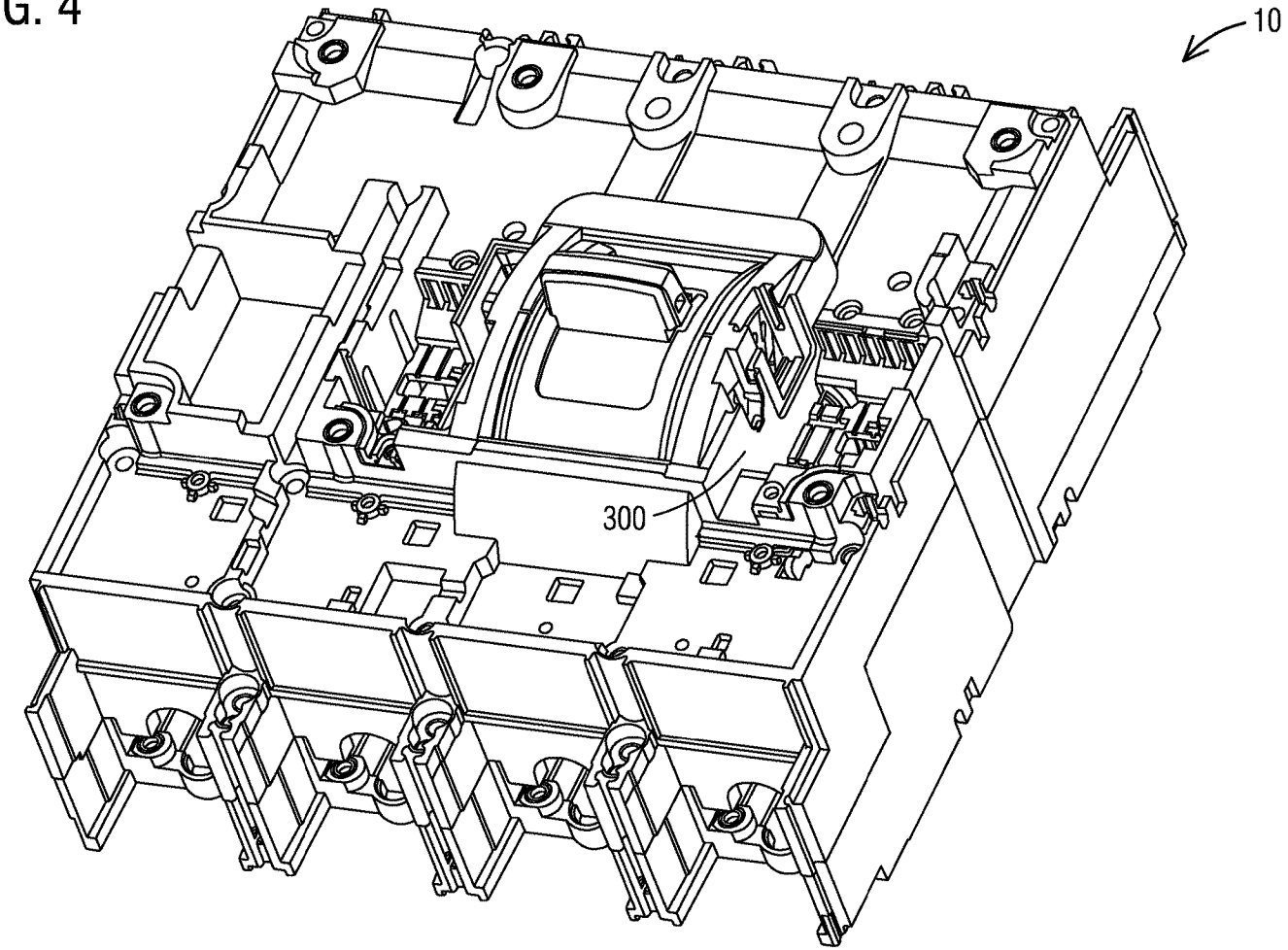
FIG. 4 illustrates an isometric view of the circuit breaker without an accessory cover in accordance with an exemplary embodiment of the present invention.

Turning now to FIG. 4, it illustrates an isometric view of the circuit breaker 10 without the accessory cover 205 in accordance with an exemplary embodiment of the present invention. Consistent with one embodiment, the circuit breaker 10 includes an accessory pocket 300 to receive a key locking device (not shown) to lock the circuit breaker 10 such that an unauthorized person is prevented from switching the circuit breaker 10 from OFF to ON or from ON to OFF states. The accessory pocket 300 may be made of hard plastic via an injection molding process.

Figure 5:
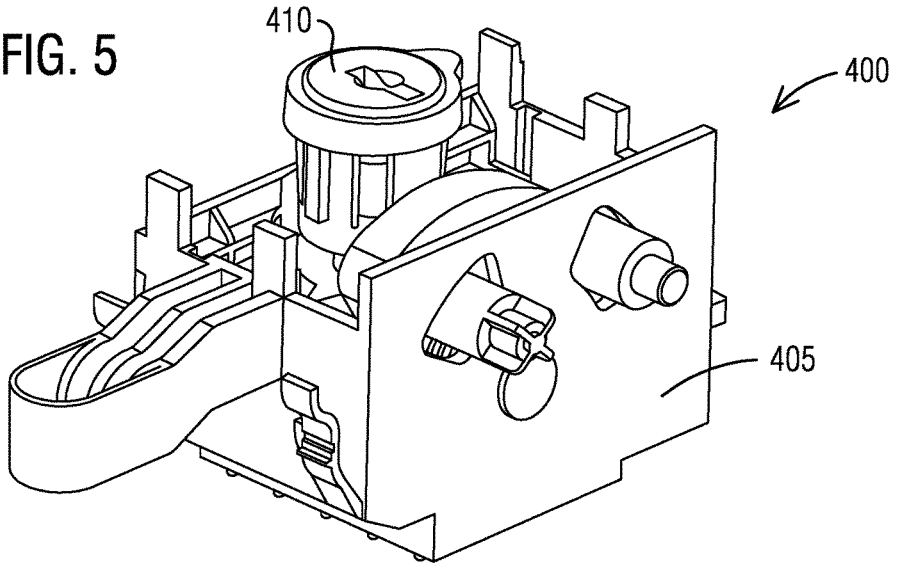
FIG. 5 illustrates an isometric view of a locking device to lock the circuit breaker of FIG. 1 in accordance with an exemplary embodiment of the present invention.

FIG. 5 illustrates an isometric view of a locking device 400 to lock the circuit breaker 10 of FIG. 1 in accordance with an exemplary embodiment of the present invention. The locking device 400 includes a first subassembly 405 that is configured to be installed in the accessory pocket 300 of FIG. 4. An example of the first subassembly 405 is a pocket assembly (see FIG. 6) including a pocket housing. The locking device 400 further includes a second subassembly 410 that is configured to be mounted to the accessory cover 300 of FIG. 4. An example of the second subassembly 410 is a cylinder lock assembly (see FIG. 7) including a cylinder lock. The first subassembly 405 and the second subassembly 410 are configured to self align upon final assembly of the circuit breaker 10 to perform a locking function of the circuit breaker 10.

A first subassembly enclosure houses a circuit breaker locking mechanism and has at least one guide pin. A cover captures the components installed onto the guide pin and holds the first subassembly 405 together. Once assembled, the first subassembly 405 can be installed into the circuit breaker accessory pocket 300 and the locking pins can be extended out of the enclosure through the holes provided depending on the location of a slider. The user may receive a fully assembled pocket subassembly. After removal of the accessory cover 205, the user can install this component directly into the accessory pocket 300 using snaps and hooks on the pocket housing guided by coding provided in the accessory pocket 300 that ensures proper placement in the accessory pocket 300.

The second subassembly 410 houses a cylinder lock and adapts it to mount into the circuit breaker accessory cover 205 and to operate the circuit breaker locking mechanism. The cylinder lock mounts into a cylinder lock housing. A flipper mounts and is fixed to the cylinder lock on the opposite side of the cylinder lock housing, holding the second subassembly 410 together. The cylinder lock assembly installs into a cylinder lock mounting hole in the accessory cover 205 and is secured by one or more snaps.

Once the two subassemblies 405, 410 are fixed to their respective circuit breaker interfaces, the accessory cover 205 is returned to the circuit breaker 10. The two subassemblies 405, 410 of the locking device 400 cooperate to perform locking of the circuit breaker 10. The locking device 400 is configured to lock the circuit breaker 10 and it is installed as two separate subassemblies 405, 410, one installed in the accessory pocket 300 of the circuit breaker 10 and the other subassembly being mounted to the accessory cover 205 of the circuit breaker 10.

Figure 6:
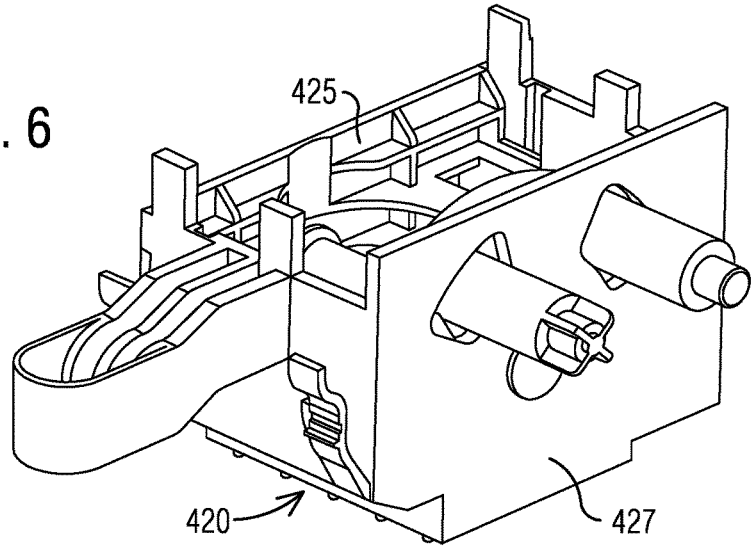
FIG. 6 illustrates an isometric view of a pocket assembly of the locking device of FIG. 5 in accordance with an exemplary embodiment of the present invention.

FIG. 6 illustrates an isometric view of a pocket assembly 420 of the locking device 400 of FIG. 5 in accordance with an exemplary embodiment of the present invention. The pocket assembly 420 includes a pocket housing 427. Consistent with one embodiment, the pocket assembly 420 may be made of hard plastic via an injection molding process. The pocket assembly 420 includes a cover 425 to enclose a locking mechanism (not shown) that interfaces with an operating mechanism of the circuit breaker 10.

The pocket assembly 420 mounts into the accessory pocket 300 and is rigidly fixed to a main housing of the circuit breaker 10. The pocket assembly 420 contains structural components that interface with a circuit breaker handle to block switching by transferring the switching forces to the main housing of the circuit breaker 10 to which the pocket assembly 420 is rigidly fixed.

Figure 7:
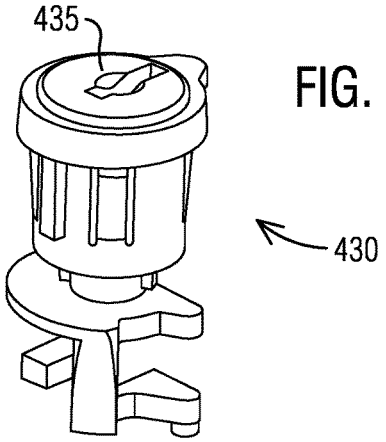
FIG. 7 illustrates an isometric view of a cylinder lock assembly of the locking device of FIG. 5 in accordance with an exemplary embodiment of the present invention.

FIG. 7 illustrates an isometric view of a cylinder lock assembly 430 of the locking device 400 of FIG. 5 in accordance with an exemplary embodiment of the present invention. The cylinder lock assembly 430 includes a cylinder lock 435. Consistent with one embodiment, the cylinder lock assembly 430 except the cylinder lock 435 may be made of a metal such as stainless steel.

The cylinder lock assembly 430 mounts to and is rigidly fixed to the circuit breaker accessory cover 205. The function of the cylinder lock assembly 430 is to provide the user access to the locking facility via key access and to translate the user's intention to lock the circuit breaker 10 to a pocket assembly via a flipper, as described in FIG. 7.

Figure 8:
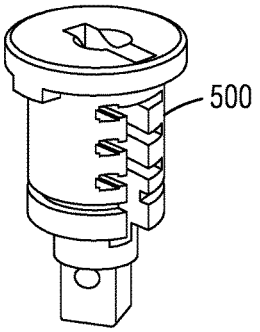
FIG. 8 illustrates an isometric view of a cylinder lock of the cylinder lock assembly of the locking device of FIG. 5 in accordance with an exemplary embodiment of the present invention.
Figure 9:
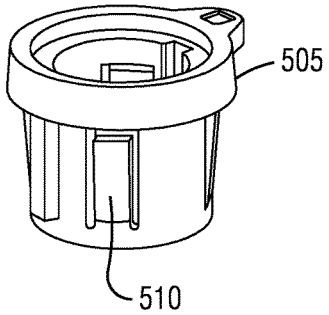
FIG. 9 illustrates an isometric view of a cylinder lock housing of the cylinder lock assembly of the locking device of FIG. 5 in accordance with an exemplary embodiment of the present invention.
Figure 10:
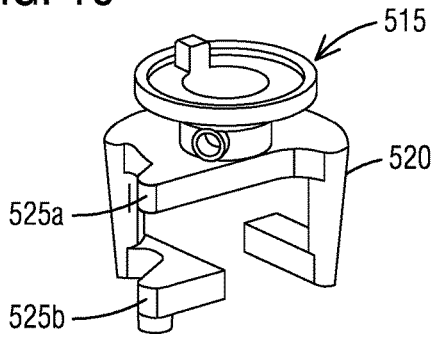
FIG. 10 illustrates an isometric view of a flipper and actuating fingers of the cylinder lock assembly of the locking device of FIG. 5 in accordance with an exemplary embodiment of the present invention.
Figure 11:
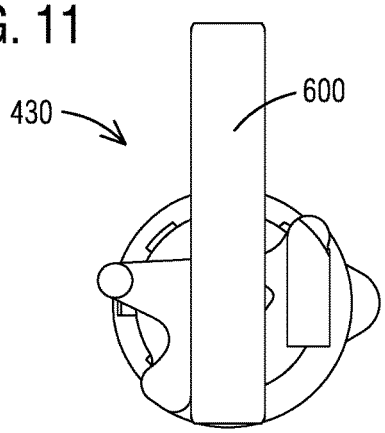
FIGS. 11-16 illustrate isometric views of the cylinder lock assembly of the locking device of FIG. 5 with a guide pin in accordance with an exemplary embodiment of the present invention.
Figure 12:
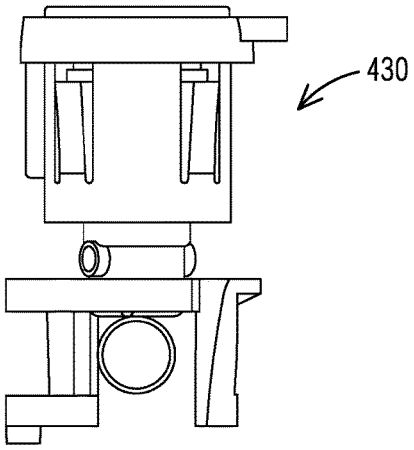
Figure 13:
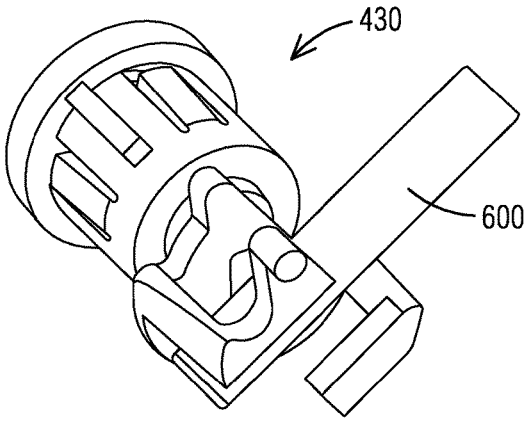
Figure 14:
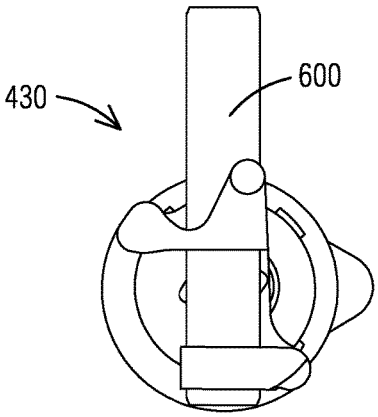
Figure 15:
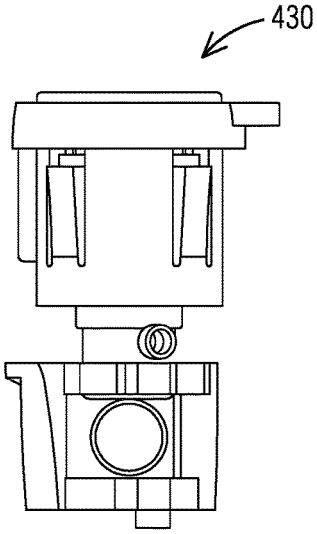
Figure 16:
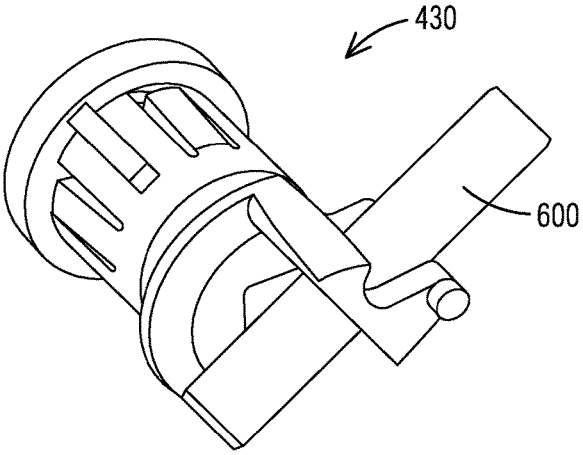

As shown in FIG. 8, it illustrates an isometric view of a cylinder lock 500 of the cylinder lock assembly 430 of the locking device 400 of FIG. 5 in accordance with an exemplary embodiment of the present invention. As shown in FIG. 9, it illustrates an isometric view of a cylinder lock housing 505 of the cylinder lock assembly 430 of the locking device 400 of FIG. 5 in accordance with an exemplary embodiment of the present invention. The cylinder lock housing 505 may include a snap 510 to snap in a position. As shown in FIG. 10, it illustrates an isometric view of a component 515 having a flipper 520 and first and second actuating fingers 525*a*, 525*b* of the cylinder lock assembly 430 of the locking device 400 of FIG. 5 in accordance with an exemplary embodiment of the present invention.

As seen in FIGS. 11-16, they illustrate views of the cylinder lock assembly 430 of the locking device 400 of FIG. 5 with a guide pin 600 in accordance with an exemplary embodiment of the present invention. The guide pin 600 is either attached to the pocket housing 425 or is held in cups between the pocket housing 425 and the cover 427 of FIG. 6. The cover 427 affixes onto the pocket housing 425 and constrains the guide pin 600. While the pocket assembly 420 includes the cover 427 to enclose a locking mechanism (see FIG. 17), a locking pin subassembly of the locking mechanism is installed onto the guide pin 600 in the pocket housing 425.

Figure 17:
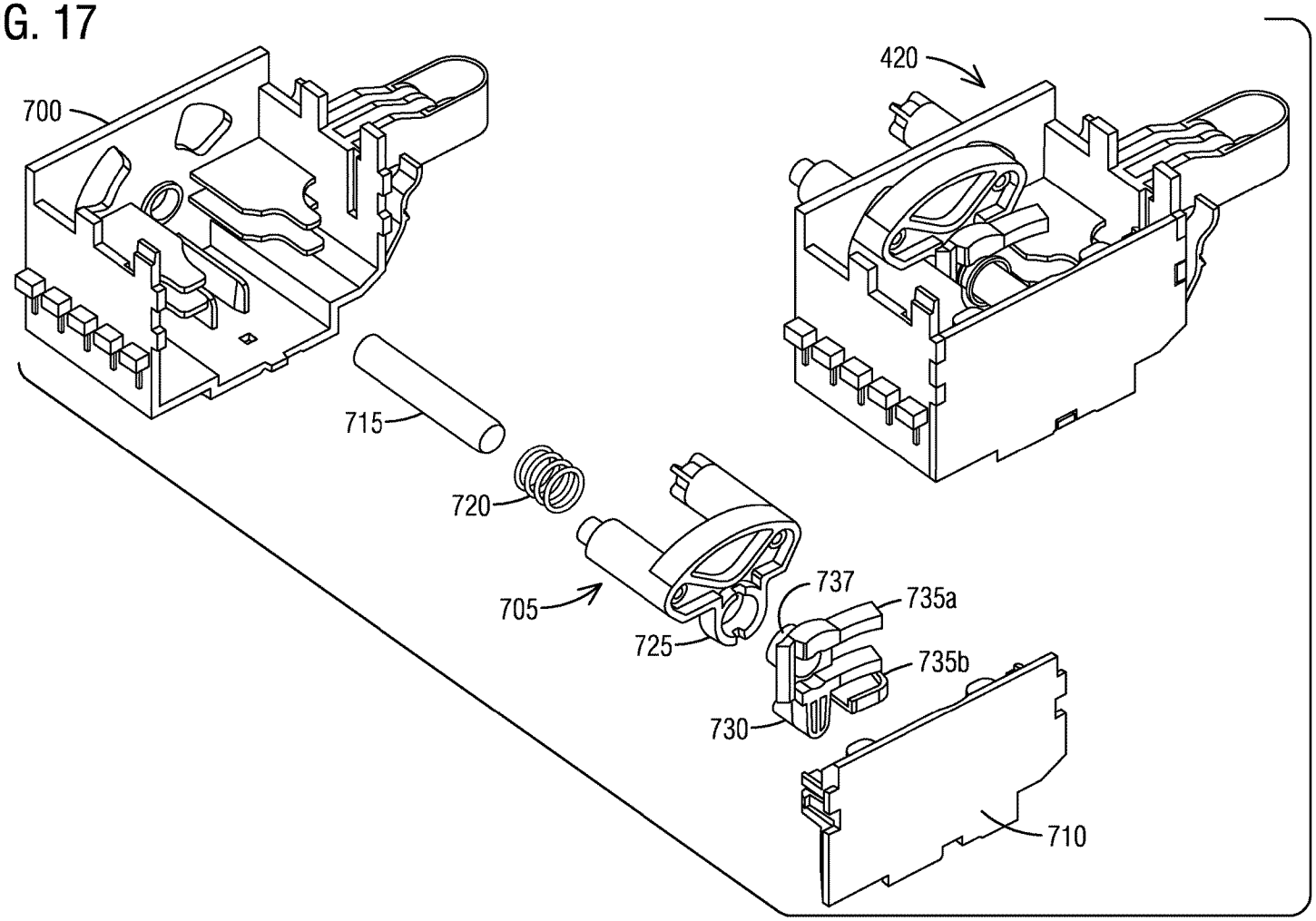
FIG. 17 illustrates an exploded view of the pocket assembly of FIG. 6 in accordance with an exemplary embodiment of the present invention.

In FIG. 17, an exploded view of the pocket assembly 420 of FIG. 6 is depicted in accordance with an exemplary embodiment of the present invention. The pocket assembly 420 includes a pocket housing 700, a locking mechanism 705 and a cover 710. The locking mechanism 705 includes a guide pin 715, a return spring 720, a locking pin subassembly 725 and a slider 730. The cover 710 affixes onto the pocket housing 700 and constrains the guide pin 715.

The guide pin 715 is either attached to the pocket housing 700 or is held in cups between the pocket housing 700 and the cover 710. The locking pin subassembly 725 has a locking pin carrier with at least one locking pin attached. The slider 730 is to be housed in the pocket housing 700 of the pocket assembly 420. The slider 730 has first and second actuating interface surfaces 735*a*, 735*b* and a hollow cylinder 737. The hollow cylinder on the slider 730 allows the slider 730 to mount about the guide pin 715 and freely slide along and rotate about the guide pin's axis.

Once the pocket assembly 420 and the cylinder lock assembly 430 are installed onto the circuit breaker components, the accessory cover 205 is returned to the circuit breaker 10. In this step, the flipper 520 is automatically aligned with the slider 730, such that the first and second actuating fingers 525*a*, 525*b* on the flipper 520 will interface with the first and second actuating interface surfaces 735*a*, 735*b* when a key is turned towards the lock state by a user.

An alignment is accomplished by cooperation between alignment features in the pocket housing 700, the cover 710, the slider 730 and the flipper 520. The slider 730 rides on the guide pin 715 and the slider 730 and the locking pin carrier are spring loaded such that they tend to slide towards the cover 710. Further, both the pocket housing 700 and the cover 710 have ribs that have a tapered profile that matches a taper provided on the flipper 520. This combination allows for misalignment to be tolerated, but corrected upon assembly of the accessory cover 205 of the circuit breaker 10.

Figure 18:
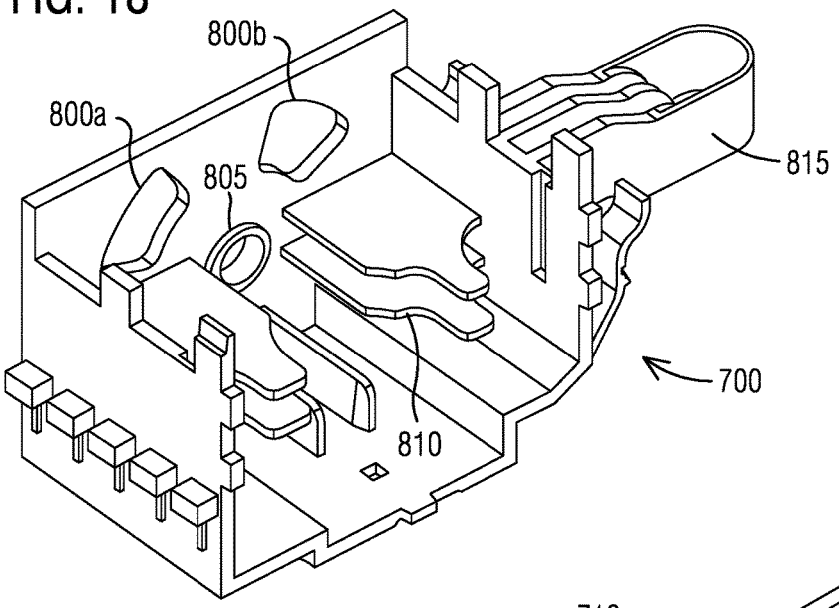
FIG. 18 illustrates an isometric view of a pocket housing of the pocket assembly of FIG. 6 in accordance with an exemplary embodiment of the present invention.

With regard to FIG. 18, it illustrates an isometric view of the pocket housing 700 of the pocket assembly 420 of FIG. 6 in accordance with an exemplary embodiment of the present invention. The pocket housing 700 includes first and second locking pin holes 800*a*, 800*b*. The pocket housing 700 further includes a first guide pin cup 805, a first flipper guide rib 810, and a fixing arm 815. The pocket assembly 420 may be fixed to the circuit breaker 10 by tying it down with a screw through the fixing arm 815. The first and second locking pin holes 800*a*, 800*b* allow for one or more locking pins to protrude through the pocket housing 700 and provide alignment once the locking pin subassembly 725 is installed onto the guide pin 715 in the pocket housing 700. The pocket housing 700 includes one or more snaps and one or more hooks and the accessory pocket 205 includes guides to ensure placement when installing the pocket assembly 420 in the accessory pocket 205 by snapping it in place.

Figure 19:
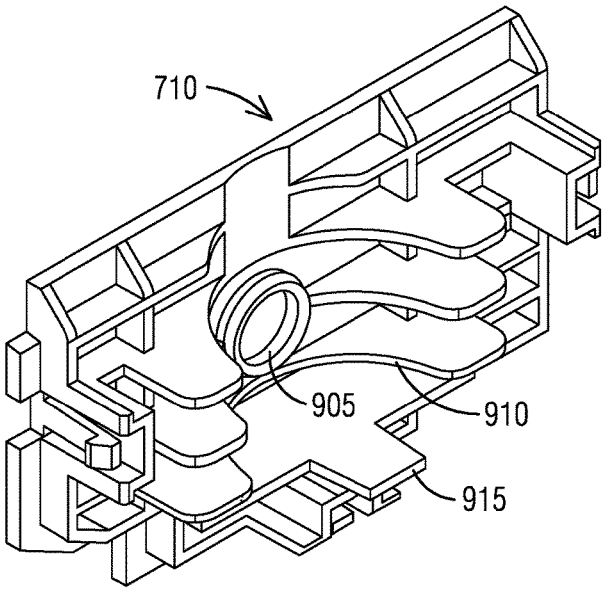
FIG. 19 illustrates an isometric view of a cover of the pocket assembly of FIG. 6 in accordance with an exemplary embodiment of the present invention.

With respect to FIG. 19, it illustrates an isometric view of the cover 710 of the pocket assembly 420 of FIG. 6 in accordance with an exemplary embodiment of the present invention. The cover 710 further includes a second guide pin cup 905, a second flipper guide rib 910, and a slider stop 915. The slider stop 915 on the cover 710 limits the movement of the slider 730 towards the cover 710 so that enough clearance is provided to allow the flipper 520 to be inserted into the pocket assembly 420. In one embodiment, the guide pin 715 is held in the first guide pin cup 805, the second guide pin cup 905 between the pocket housing 700 and the cover 710.

Figure 20:
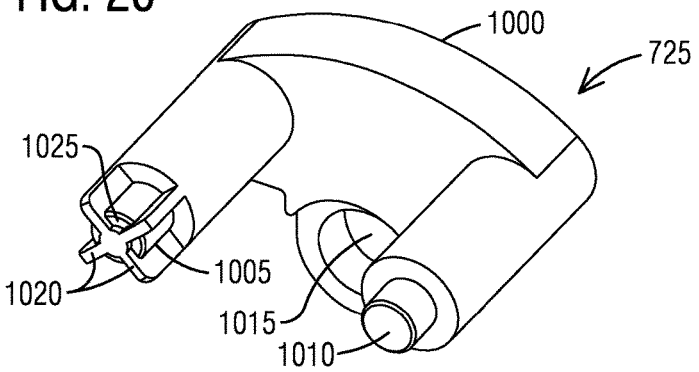
FIG. 20 illustrates an isometric view of a locking pin subassembly of the pocket assembly of FIG. 6 in accordance with an exemplary embodiment of the present invention.

In accordance with an exemplary embodiment of the present invention, FIG. 20 illustrates an isometric view of the locking pin subassembly 725 of the pocket assembly 420 of FIG. 6. The locking pin subassembly 725 includes a locking pin carrier 1000 with an ON locking pin 1005 and an OFF locking pin 1010 attached. The locking pin subassembly 725 further includes a mounting hole 1015 in the locking pin carrier 1000.

The mounting hole 1015 is configured to allow at least one locking pin to be mounted about the hollow cylinder 737 that is provided on the slider 730. The return spring 720 is installed about the guide pin 715 between the locking pin subassembly 725 and the pocket housing 700 to aid in the locking mechanism 705 return and to maintain a contact between the locking pin carrier 1000 and the slider 730.

A plurality of blocking tabs 1020(1-4) are provided over a tip 1025 of the ON locking pin 1005. The plurality of blocking tabs 1020(1-4) have a diameter greater than the diameter of an ON locking hole among the first and second locking pin holes 800*a*, 800*b*, therefore blocking any attempt to insert the ON locking pin 1005 into the ON locking hole on the circuit breaker handle, thus preventing locking of the circuit breaker 10 in the ON state.

The plurality of blocking tabs 1020(1-4) are molded over an exposed end of the ON locking pin 1005 to provide access to a feature of locking the circuit breaker 10 in an ON state by a user by mechanically modifying the locking pin subassembly 725 by removing one or more blocking tabs of the plurality of blocking tabs 1020(1-4) to fully expose the ON locking pin 1005. Accordingly, a modification is required to activate the locking ON feature. This modification is irreversible and distinct to show a user intent. This provision allows a user to add the locking ON feature selectively via an irreversible and deliberate, but simple modification.

The techniques described herein can be particularly useful for locking with a key locking device a Circuit Breaker (CB). While particular embodiments are described in terms of the cylinder lock 500, the techniques described herein are not limited to cylinder locks but can also use locks with other locking mechanisms, such as sliding locks.

Figure 21:
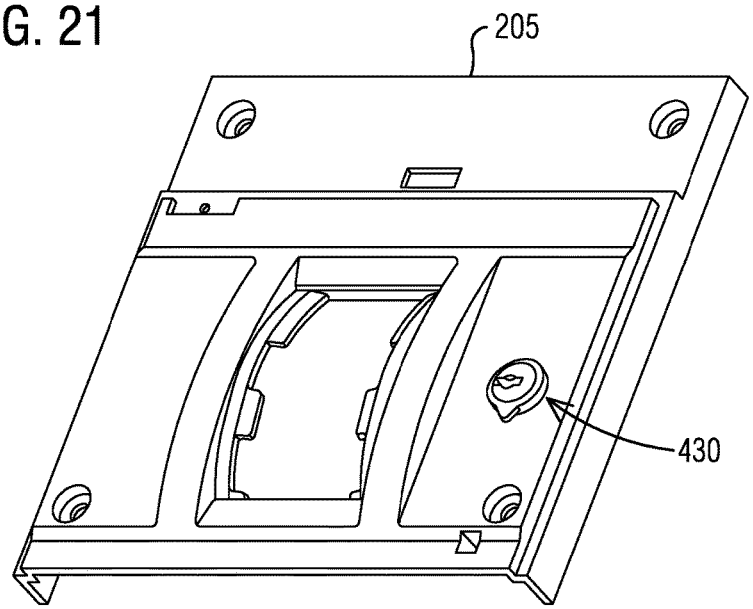
FIG. 21 illustrates an isometric view of an accessory cover with a cylinder lock assembly in accordance with an exemplary embodiment of the present invention.
Figure 22:
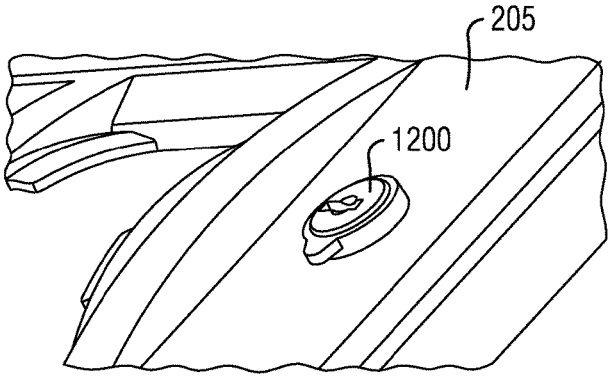
Figure 23:
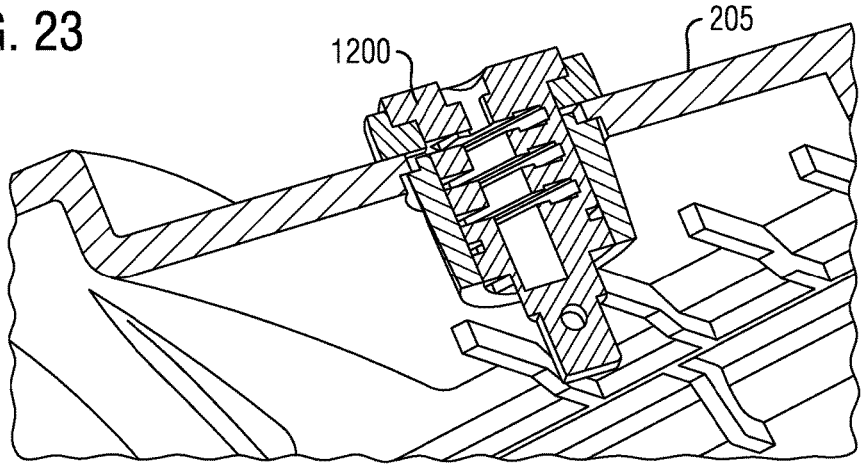

FIG. 21 illustrates an isometric view of the accessory cover 205 with the cylinder lock assembly 430 in accordance with an exemplary embodiment of the present invention. FIGS. 22-24 illustrate isometric and cross-sectional views of the accessory cover 205 without a ring and a lock 1200 in accordance with an exemplary embodiment of the present invention. FIG. 25 illustrates an isometric view of the accessory cover 205 without a ring in accordance with an exemplary embodiment of the present invention.

FIGS. 26-29 illustrate views of a cylinder lock 1600 and a lock housing 1605 in accordance with an exemplary embodiment of the present invention. The lock housing 1605 is provided to mount the cylinder lock 1600 of the cylinder lock assembly 430. The lock housing 1605 includes a snap 1610. The accessory cover 205 having a cylinder lock mounting hole installs the cylinder lock assembly 430 using the snap 1610 of the lock housing 1605. When the circuit breaker 10 is locked with the cylinder lock assembly 430, the flipper 520 captures the guide pin 715 locking the cylinder lock assembly 430 to the pocket assembly 420 thus preventing the separation of two assemblies.

Figure 30:
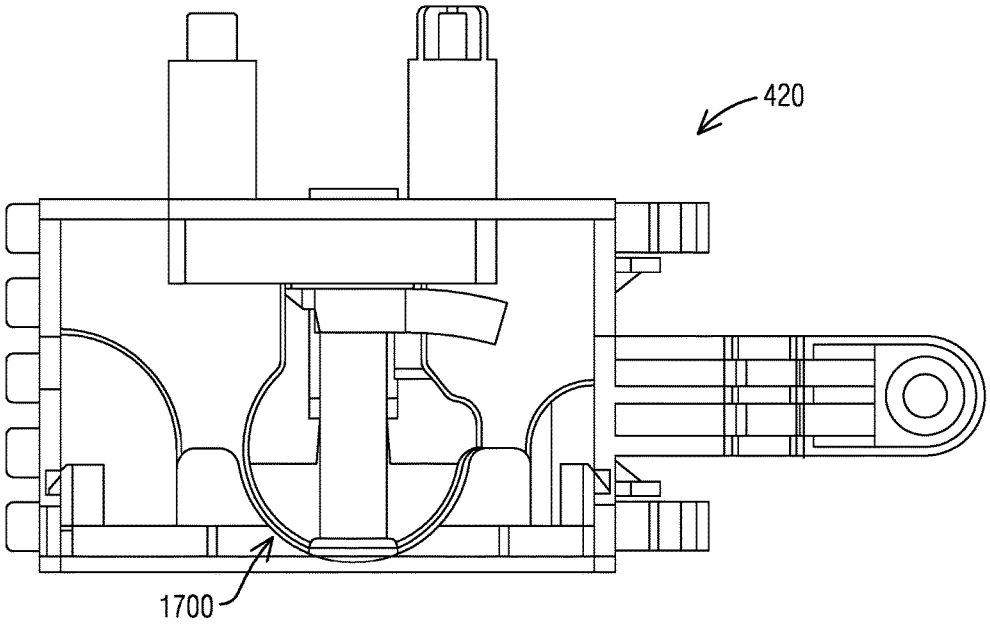
FIGS. 30-31 illustrate a top view of a pocket assembly and a cylinder lock assembly respectively to show alignment during assembly in accordance with an exemplary embodiment of the present invention.
Figure 31:
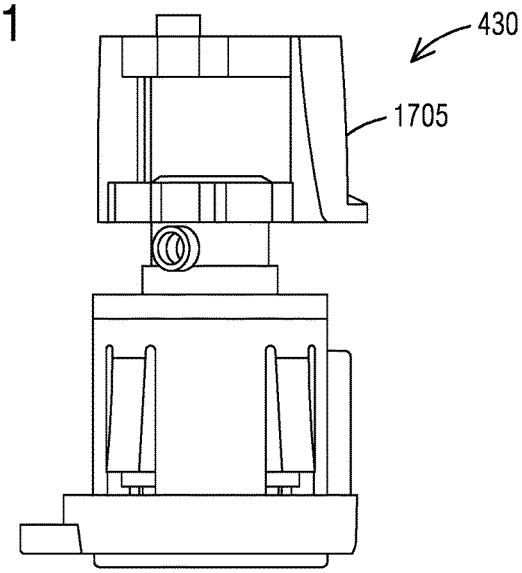

FIGS. 30-31 illustrate a top view of the pocket assembly 420 and the cylinder lock assembly 430 respectively to show alignment during assembly in accordance with an exemplary embodiment of the present invention. The pocket assembly 420 includes a guide rib alignment taper 1700. Likewise, the cylinder lock assembly 430 includes a flipper alignment taper 1705. The guide rib alignment taper 1700 and the flipper alignment taper 1705 are matching tapers which aid in alignment during assembly.

FIGS. 32-34 illustrate views of the cylinder lock assembly 430 with the locking pin subassembly 725 in an unlocked state in accordance with an exemplary embodiment of the present invention. In FIG. 32, an arrow 1800 indicates a key turn direction to lock the locking device 400. FIGS. 35-37 illustrate views of the cylinder lock assembly 430 with the locking pin subassembly 725 in a locked state in accordance with an exemplary embodiment of the present invention.

FIG. 38 illustrates an isometric view of a handle 2000 of the circuit breaker 10 in accordance with an exemplary embodiment of the present invention. The handle 2000 includes an ON locking hole 2005 and an OFF locking hole 2010.

Once assembled, the locking device 400 translates a user key turn to the locked position to at least one of the locking pins 1005, 1010 in the locking pin subassembly 725, blocking the switching motion of the handle 2000. In this locking device 400, a counter-clock-wise turn of the cylinder lock 500 puts the lock into the locked state. Since the cylinder in the lock is directly coupled to the flipper 520, this action is directly translated to the flipper 520.

In operation, the first and second actuating fingers 525*a*, 525*b* of the flipper 520 touch the first and second actuating interface surfaces 735*a*, 735*b* on the slider 730 and apply a force tending to push the slider 730 and thus the locking pin subassembly 725 away from the cover 710 and towards the circuit breaker handle 2000. If the circuit breaker's handle 2000 in a lockable state, that is, locking pins 1005, 1010 align with the locking holes 2005, 2010 in the handle 2000, the pin interfaces with the handle 2000, blocking handle motion. If the circuit breaker 10 is not in a lockable state, the motion of the locking pins 1005, 1010 is blocked and the circuit breaker 10 cannot be locked. The key cannot be advanced to the locked position and the when the user releases the key, the spring loading of the mechanism returns the system, including the key rotation to the unlocked state.

Figure 40:
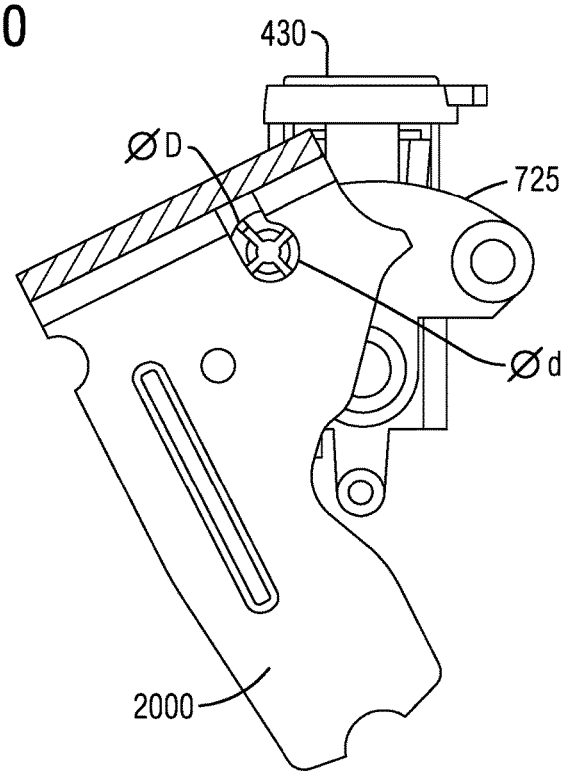
FIG. 40 illustrates a cross-sectional view of the handle of the circuit breaker and the cylinder lock assembly with the locking pin subassembly of FIG. 39 in accordance with an exemplary embodiment of the present invention.

FIG. 39 illustrates a side view of the handle 2000 of the circuit breaker 10 and the cylinder lock assembly 430 with the locking pin subassembly 725 in accordance with an exemplary embodiment of the present invention. FIG. 40 illustrates a cross-sectional view of the handle 2000 of the circuit breaker 10 and the cylinder lock assembly 420 with the locking pin subassembly 725 of FIG. 39 from an axis X-X in accordance with an exemplary embodiment of the present invention.

Embodiments of the present invention provide an anti-defeat configuration as the pocket assembly 420 is fixed to the circuit breaker accessory pocket 300, the cylinder lock assembly 430 is fixed to the accessory cover 205 and neither can be removed when the accessory cover 205 is installed. When the circuit breaker 10 is locked with the cylinder lock assembly 430, the flipper 520 captures the guide pin 715 locking the cylinder lock assembly 430 to the pocket assembly 420. This prevents the separation of the two sub-assemblies. Therefore, this feature prevents removal of the accessory cover 205 from the circuit breaker 10, eliminating the chance of defeating the locking device 400 by disassembly by unauthorized persons.

Embodiments of the present invention provide an ability to selectively lock in an ON state the circuit breaker 10 with a distinct positive action. The provision allows a user to add the locking ON selectively via an irreversible and deliberate, but simple modification. This modification is accomplished by coordinated features in the locking pin subassembly 725 and the circuit breaker handle 2000. Locking in the ON state of the circuit breaker 10 occurs when the ON locking pin 1005 engages with/is inserted into the ON locking hole 2005 on the circuit breaker handle 2000.

As manufactured, it is impossible to lock the circuit breaker 10 in the ON state due to the one or more blocking tabs 1020(1-4) that are molded over the exposed end of the of the ON locking pin 1005. The blocking tabs 1020(1-4) have a diameter greater than the diameter of the ON locking hole 2005, therefore blocking any attempt to insert the ON locking pin 1005 into the ON locking hole 2005 on the circuit breaker handle 2000, thus preventing locking of the circuit breaker 10 in the ON state. To access the feature of locking the circuit breaker 10 in the ON state, the user must mechanically modify the locking pin subassembly 725 by removing the blocking tab(s) 1020(1-4) to fully expose the ON locking pin 1005. This modification can be accomplished with a blade, a rotary tool, diagonal pliers or a similar tool. Such a modification will both be irreversible and indicate user intent.

Figure 41:
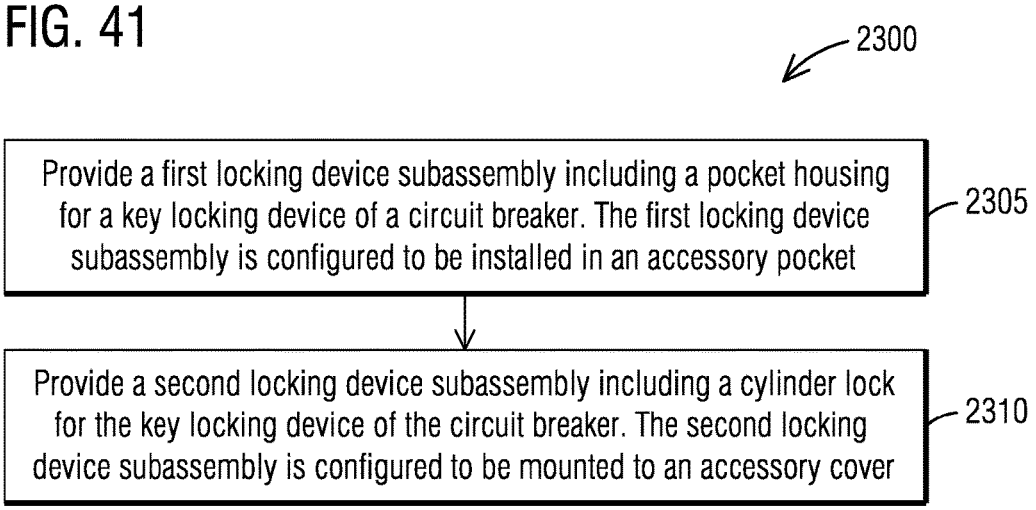
FIG. 41 illustrates a flow chart of a method of locking a circuit breaker in accordance with an exemplary embodiment of the present invention.

FIG. 41 illustrates a flow chart of a method 2300 of locking the circuit breaker 10 in accordance with an exemplary embodiment of the present invention. Reference is made to the elements and features described in FIGS. 1-40. It should be appreciated that some steps are not required to be performed in any particular order, and that some steps are optional.

In step 2305, the method 2300 includes providing a first locking device subassembly including a pocket housing. The first locking device subassembly is configured to be installed in the accessory pocket 300 of the circuit breaker 10. The method 2300 further includes at step 2310 providing a second locking device subassembly including the cylinder lock 500. The second locking device subassembly is configured to be mounted to the accessory cover 205 of the circuit breaker 10. The first locking device subassembly and the second locking device subassembly are configured to self align upon final assembly of the circuit breaker 10 to perform a locking function of the circuit breaker 10 such that an unauthorized person is prevented from switching the circuit breaker 10 from OFF to ON or from ON to OFF states.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A key locking device accessory for use with a circuit breaker, the key locking device accessory comprising:

a locking device to lock the circuit breaker such that an unauthorized person is prevented from switching the circuit breaker from an OFF state to an ON state or from the ON state to the OFF state, the locking device including:

a first subassembly including a pocket housing, the first subassembly is configured to be installed in an accessory pocket, a second subassembly including a cylinder lock, the second subassembly is configured to be mounted to an accessory cover, and wherein the first subassembly and the second subassembly are configured to self align upon final assembly of the circuit breaker to perform a locking function of the circuit breaker, wherein the first subassembly including a cover to enclose a locking mechanism that interfaces with an operating mechanism of the circuit breaker.

2. The key locking device accessory of claim 1, wherein the locking mechanism includes:

a guide pin either attached to the pocket housing or is held in cups between the pocket housing and the cover;

a return spring;

a locking pin subassembly having a locking pin carrier with at least one locking pin attached; and a slider to be housed in the pocket housing of the first subassembly, the slider having a hollow cylinder.

3. The key locking device accessory of claim 2, wherein the second subassembly includes:

a lock housing to mount the cylinder lock of the second subassembly, the lock housing having a snap; and a component including a flipper and at least one actuating finger.

4. The key locking device accessory of claim 3, wherein the accessory cover having a cylinder lock mounting hole to install the second subassembly using the snap of the lock housing.

5. A circuit breaker, comprising:

an accessory pocket;

an accessory cover; and a locking device to lock the circuit breaker such that an unauthorized person is prevented from switching the circuit breaker from an OFF state to an ON state or from the ON state to the OFF state, the locking device including:

a first subassembly including a pocket housing, the first subassembly is configured to be installed in the accessory pocket, a second subassembly including a cylinder lock, the second subassembly is configured to be mounted to the accessory cover, and wherein the first subassembly and the second subassembly are configured to self align upon final assembly of the circuit breaker to perform a locking function of the circuit breaker, wherein the first subassembly including a cover to enclose a locking mechanism that interfaces with an operating mechanism of the circuit breaker.

6. The circuit breaker of claim 5, wherein the pocket housing having one or more snaps and one or more hooks and the accessory pocket having guides to ensure placement for installing the first subassembly in the accessory pocket by snapping it in place.

7. The circuit breaker of claim 5, wherein the locking mechanism includes:

a guide pin either attached to the pocket housing or is held in cups between the pocket housing and the cover;

a return spring;

a locking pin subassembly having a locking pin carrier with at least one locking pin attached; and a slider to be housed in the pocket housing of the first subassembly, the slider having a hollow cylinder.

8. The circuit breaker of claim 7, wherein the locking pin carrier having a hole to allow the at least one locking pin to be mounted about the hollow cylinder that is provided on the slider.

9. The circuit breaker of claim 7, wherein the return spring is installed about the guide pin between the locking pin subassembly and the pocket housing to aid in the locking mechanism return and to maintain a contact between the locking pin carrier and the slider.

10. The circuit breaker of claim 7, wherein the cover affixes onto the pocket housing and constrains the guide pin.

11. The circuit breaker of claim 7, wherein the pocket housing including first and second holes to allow for one or more locking pins to protrude through the pocket housing and provide alignment once the locking pin subassembly is installed onto the guide pin in the pocket housing.

12. The circuit breaker of claim 7, further comprising:

one or more blocking tabs molded over an exposed end of an ON locking pin to provide access to a feature of locking the circuit breaker in an ON state by a user by mechanically modifying the locking pin subassembly by removing the one or more blocking tabs to fully expose the ON locking pin.

13. The circuit breaker of claim 7, wherein the second subassembly includes a lock housing to mount the cylinder lock of the second subassembly, the lock housing having a snap; and a component including a flipper and at least one actuating finger.

14. The circuit breaker of claim 13, wherein the accessory cover having a cylinder lock mounting hole to install the second subassembly using the snap of the lock housing.

15. The circuit breaker of claim 13, wherein when the circuit breaker is locked with the second subassembly, the flipper captures the guide pin locking the second subassembly to the first subassembly thus preventing the separation of the first and second sub-assemblies.

16. A method of locking a circuit breaker, the method comprising:

providing a first locking device subassembly including a pocket housing, the first locking device subassembly is configured to be installed in an accessory pocket; and providing a second locking device subassembly including a cylinder lock, the second locking device subassembly is configured to be mounted to an accessory cover, wherein the first locking device subassembly and the second locking device subassembly are configured to self align upon final assembly of the circuit breaker to perform a locking function of the circuit breaker such that an unauthorized person is prevented from switching the circuit breaker from an OFF state to an ON state or from the ON state to the OFF state, wherein the first locking device subassembly including a cover to enclose a locking mechanism that interfaces with an operating mechanism of the circuit breaker, wherein the locking mechanism includes:

a guide pin either attached to the pocket housing or is held in cups between the pocket housing and the cover;

a return spring;

a locking pin subassembly having a locking pin carrier with at least one locking pin attached; and a slider to be housed in the pocket housing of the first locking device subassembly, the slider having a hollow cylinder.

17. The method of claim 16, wherein the second locking device subassembly includes:

a lock housing to mount the cylinder lock of the second locking device subassembly, the lock housing having a snap; and a component including a flipper and at least one actuating finger.

* * * * *